US007402098B2

(12) United States Patent
Severson et al.

(10) Patent No.: US 7,402,098 B2
(45) Date of Patent: Jul. 22, 2008

(54) CARRIER HEAD FOR WORKPIECE PLANARIZATION/POLISHING

(75) Inventors: Brian Severson, Chandler, AZ (US); John Stumpf, Phoenix, AZ (US); Stephen C. Schultz, Gilbert, AZ (US)

(73) Assignee: Novellus Systems, Inc., San Jose, CA (US)

( * ) Notice: Subject to any disclaimer, the term of this patent is extended or adjusted under 35 U.S.C. 154(b) by 71 days.

(21) Appl. No.: 11/553,572

(22) Filed: Oct. 27, 2006

(65) Prior Publication Data

US 2008/0102732 A1 May 1, 2008

(51) Int. Cl.
*B24B 7/22* (2006.01)

(52) U.S. Cl. ..... 451/288; 451/398; 451/388

(58) Field of Classification Search ..... 451/288, 451/287, 289, 290, 388, 398
See application file for complete search history.

(56) References Cited

U.S. PATENT DOCUMENTS 5,964,653 A * 10/1999 Perlov et al. ..... 451/288
6,659,850 B2 12/2003 Korovin et al.
6,663,466 B2 * 12/2003 Chen et al. ..... 451/8
6,872,130 B1 * 3/2005 Zuniga ..... 451/287
6,957,998 B2 * 10/2005 Togawa ..... 451/8
7,207,871 B1 * 4/2007 Zuniga et al. ..... 451/288

* cited by examiner

*Primary Examiner*—Robert Rose
(74) *Attorney, Agent, or Firm*—Ingrassia Fisher & Lorenz, P.C.

(57) ABSTRACT

An edge control system for deployment on a CMP carrier head comprising a bladder and a carrier head housing having a passage extending therethrough. The bladder includes a flexible diaphragm and is coupled to the carrier head housing. The edge control system comprises first and second annular ribs, each of which comprises a first end portion sealingly coupled to the carrier head housing, a second end portion coupled to the diaphragm, and a strain relief member substantially intermediate the first end portion and the second end portion. A plenum is substantially defined by the first and second annular ribs and the carrier head housing. The passage is fluidly coupled to the plenum to permit the pressurization of the plenum, and the strain relief member promotes the extension of the first and second annular ribs away from the carrier head housing when the plenum is pressurized.

16 Claims, 12 Drawing Sheets

CARRIER HEAD FOR WORKPIECE PLANARIZATION/POLISHING

FIELD OF THE INVENTION

The present invention generally relates to workpiece processing and, more particularly, to a carrier head for use in the chemical mechanical polishing or planarizing of a workpiece, such as a semiconductor wafer.

BACKGROUND OF THE INVENTION

For a variety of workpieces (e.g., semiconductor wafers, optical blanks, memory disks, etc.), manufacture requires the substantial planarization of at least one major workpiece surface. For ease of description and understanding, the following description will concentrate on exemplary embodiments of the present invention pertinent to semiconductor wafers. It should be understood, however, that the inventive carrier head may be utilized to planarize a wide variety of workpieces in addition to semiconductor wafers. Furthermore, as appearing herein, the term "planarization" is used in its broadest sense and includes any chemical and/or mechanical process that may be utilized to smooth (e.g., remove irregular topographical features from, change the thickness of, etc.) or polish the surface of a workpiece.

The technique of chemical mechanical polishing, also known as chemical mechanical planarization (referred to herein collectively as "CMP"), has been widely adopted for the planarization of semiconductor wafers. CMP processes produce a substantially smooth, planar face along a major surface of the wafer (referred to herein as the wafer's front surface) to prepare the workpiece surface for subsequent fabrication processes (e.g., photoresist coating, pattern definition, etc.). During CMP, an unprocessed wafer is transferred to a carrier head, which then presses the wafer against a polishing surface (e.g., a polish pad) supported by a platen. Polishing slurry is introduced between the wafer's front surface and the polish pad (e.g., via conduits provided through the polish pad), and relative motion (e.g., rotational, orbital, and/or linear) is initiated between the polish pad and the wafer carrier. The mechanical abrasion of the polish pad and the chemical interaction of the slurry produce a substantially planar topography along the wafer's front surface.

One known type of carrier head generally includes a flexible membrane or bladder that contacts the back (i.e., the unpolished) surface of the work piece during the CMP process. The bladder may be secured to the carrier head by way of a plurality of clamp rings threadably coupled to bolts extending through the carrier head housing. Multiple pressure chambers or plenums are provided behind the bladder to form a number of annular pressure zones across the bladder's working face. The pressure within each zone is independently adjusted to vary the force applied to the wafer's back surface at different locations. The CMP apparatus may be provided with an induction system (e.g., a closed-loop eddy current system) to monitor the topographical features of the wafer's front surface during polishing/planarization. For example, the induction system may identify thicker wafer surface areas requiring a higher rate of removal, and the pressure within the zone or zones corresponding to the thicker surface areas may be increased accordingly. After a major surface of the wafer has been satisfactorily planarized, the carrier head ejects the wafer by, for example, expanding a central portion of the bladder to physically force the wafer away therefrom (commonly referred to as "bullfrogging").

Despite extensive engineering, conventional carrier heads are still limited in certain respects. For example, the utilization of multiple clamp rings and bolts to attach the bladder to the carrier head housing increases the overall complexity and weight of the carrier head and further complicates the task of refurbishing the carrier head (e.g., replacing exhausted bladders). Moreover, the tightening of each bolt may produce a relatively high and localized clamping force. Consequently, large portions of the carrier head (e.g., the carrier head housing) must typically made of a metal capable of withstanding high axial forces without deformation. The manufacture of the carrier head housing and other carrier head components from metal not only increases the weight of the carrier head, but may also lead to carrier head interference (e.g., signal attenuation) with the induction system utilized to monitor wafer topography during the CMP process.

The limitations associated with conventional carrier head designs are not solely attributable to the bladder attachment means; e.g., known wafer ejectment systems have certain drawbacks as well. By ejecting a wafer in the manner described above, the bladder may place undue stress on inner portions of the wafer. Furthermore, expanding a central portion of the bladder to eject a supported wafer may create suction between the bladder and the wafer, which may ultimately prevent wafer ejection. As a still further limitation, conventional carrier head designs do not provide a large degree of bladder control proximate the outer peripheral edge of the bladder. Consequently, it is difficult to precisely control the planarization of the outer edge of the wafer (e.g., the outer 4-5 mm of a 300 mm wafer), which may result in lower die yields.

In view of the above, it should be appreciated that it would be desirable to provide a CMP carrier head suitable for planarizing a workpiece (e.g., a semiconductor wafer) that overcomes the limitations associated with conventional carrier head designs. In particular, it would be desirable if such a carrier head employed an improved bladder attachment design that utilizes less components, that facilitates refurbishing, and that permits components of the carrier head (e.g., the carrier housing) to be made of materials having lower compressive strengths (e.g., a polymer, such as plastic). In addition, it should be appreciated that it would be advantageous if such a carrier utilized an improved ejection system that did not unduly stress the wafer or create suction between the wafer and the bladder during ejectment. Finally, it should be appreciated that it would be desirable if such a carrier head included a system for providing improved bladder control proximate the outer edge of the wafer during planarization/polishing. Other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and.

DETAILED DESCRIPTION OF EXEMPLARY EMBODIMENTS

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
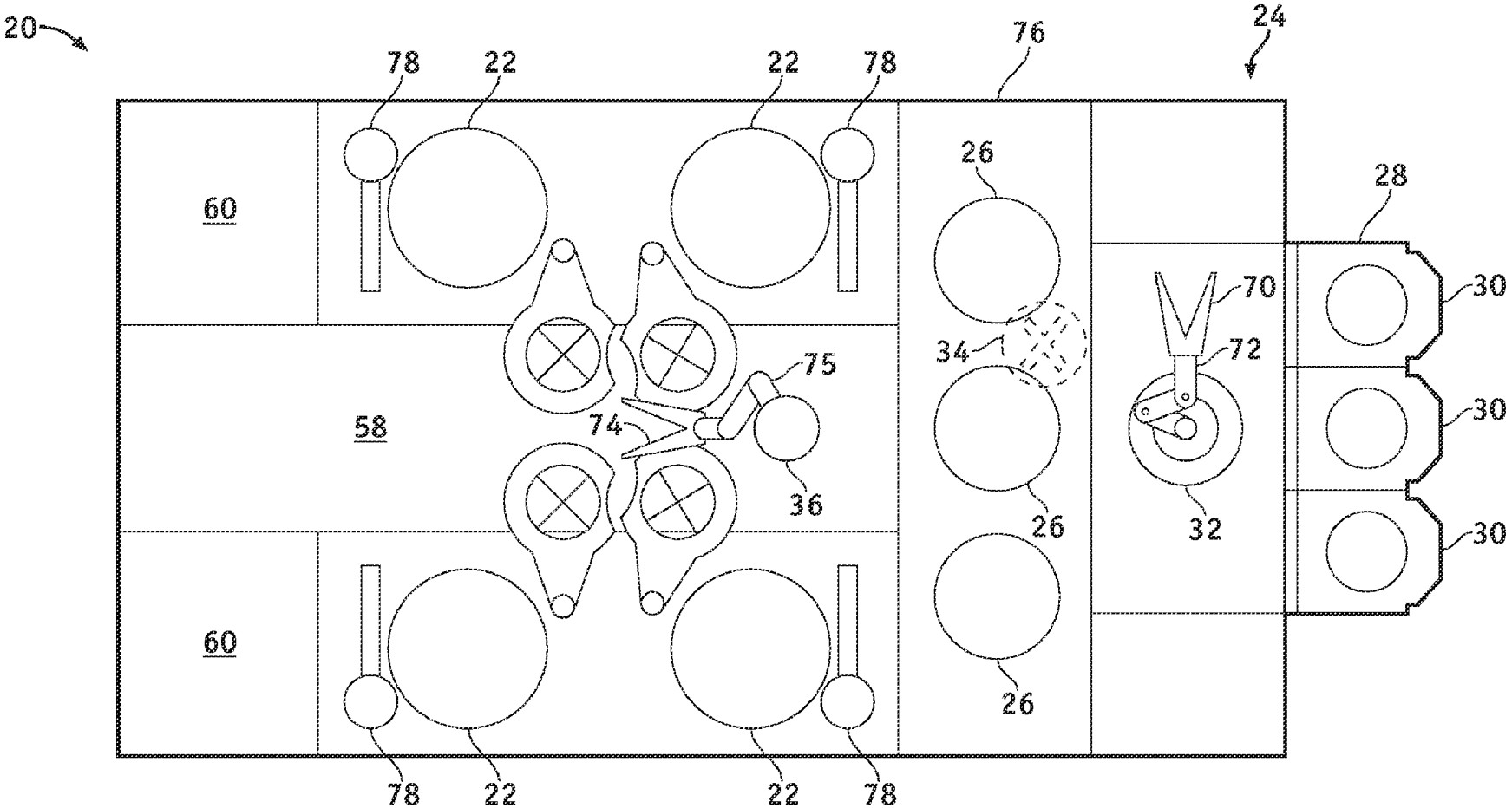
FIG. 1 is top functional view of a known CMP apparatus.

FIG. 1 is a top functional view of a CMP apparatus 20 comprising a plurality of CMP systems 22, which are arranged in two rows and separated by a service access corridor 58. Electrical cabinets 60 may be disposed on either side of corridor 58 to provide storage space for electrical boards, controllers, and the like. CMP systems 22 each comprise a carrier head and a polish pad, which are described in detail below in conjunction with FIG. 2. The polish pad may be conditioned by a pad conditioner 78 comprising an abrasive element attached to an arm configured to pivot from an off-pad location (illustrated) to a conditioning position whereat the abrasive element sweeps across the polish pad. A front end module 24 resides adjacent CMP systems 22 opposite cabinets 60. Front end module 24 includes (1) a cleaning module 76 having a plurality of cleaning stations 26 thereon, and (2) a wafer cache station 28 capable of accommodating a plurality of wafer caches 30. During the CMP process, unprocessed wafers are retrieved from wafer caches 30, cleaned at cleaning stations 26, and then planarized/polished by CMP systems 22. After planarization/polishing, the wafers may again be transferred to cleaning stations 26 for post-planarization cleaning and, finally, returned to caches 30 for transport.

First and second transfer robots 32 and 36 may be mounted on front end module 24 and utilized to transport wafers amongst the various stations of CMP apparatus 20. Front end transfer robot 32 may comprises an extensible arm 72 having an end effector 70 attached thereto. Similarly, transfer robot 36 may comprise an extensible arm 75 having an end effector 74 attached thereto. Transfer robots 32 and 36 are configured to grasp wafers such that end effectors 70 and 74 contact only the outer periphery of the wafer's back surface or the wafer's outer edge. During operation of CMP apparatus 20, first transfer robot 32 transfers selected wafers from caches 30 to a wafer hand off station 34 disposed on cleaning module 76. As shown in FIG. 1, wafer hand off station 34 resides at a location accessible to both front end robot 32 and transfer robot 36 (e.g., underneath cleaning stations 26). Second transfer robot 36 then retrieves the transferred wafer from hand off station 34, inverts the wafer so that its front surface (i.e., the surface to be polished/planarized) is facing downward, and delivers the wafer to a load cup associated with one of CMP systems 22.

Figure 2:
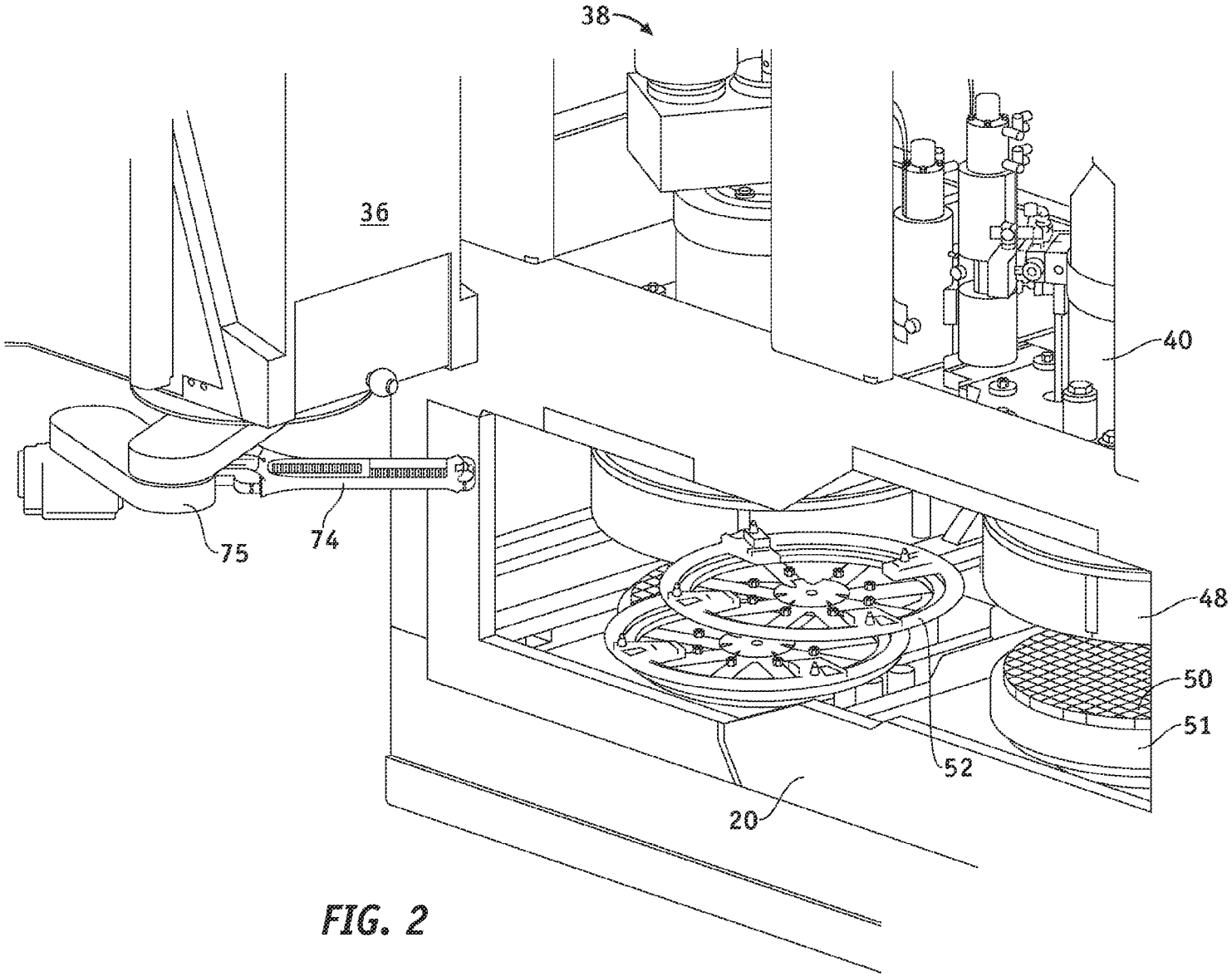
FIG. 2 is an isometric view of two CMP systems employed in the CMP apparatus shown in FIG. 1.

FIG. 2 is an isometric view of two neighboring CMP systems 38 and 40 that may be employed by CMP apparatus 20. CMP systems 38 and 40 are substantially identical and operate in a similar manner; thus, only CMP system 40 will be discussed herein below. CMP system 40 comprises a wafer carrier head 48 and a polish pad 50 deployed on a polish platen 51. CMP system 40 may also include a load cup 52 that is configured to transfer wafers to and from carrier head 48. Load cup 52 is configured to pivot about an axis from an off-load position (illustrated) to a load position underneath and aligned with wafer carrier head 48. When in the off-load position, load cup 52 may receive an unprocessed wafer from transfer robot 36. After receiving an unprocessed wafer, load cup 52 pivots about its axis to the load position in which load cup 52 is raised to contact wafer carrier head 48 so as to enable wafer transfer to carrier head 48. Load cup 52 then lowers to a plane below wafer carrier head 48 and pivots back to the off-load position.

After load cup 52 has returned to the off-load position, wafer carrier head 48 is lowered to place the surface of the wafer in contact with polish pad 50 mounted on polish platen 51. Polish slurry is supplied to the surface of polish pad 50, and relative motion (e.g., rotational, orbital, and/or linear) is initiated between pad 50 and the wafer carrier head 48 and, therefore, between pad 50 and the wafer supported by carrier head 48. The front surface of the wafer is polished by the mechanical abrasive action and by the chemical reaction of the slurry with the constituents of the wafer surface. The CMP process terminates when the planarization is complete or when the process has reached a predetermined intermediate point, and carrier head 48 is raised to a position out of contact with polish pad 50. Load cup 52 again pivots about its axis to the load position, and the processed wafer is transferred from wafer carrier head 48 to load cup 52. If desired, load cup 52 may spray the planarized surface of the processed wafer with a fluid (e.g., a surfactant) that helps maintain the hydrophilic state of the planarized surface. Load cup 52 then pivots about its axis to the off-load position in which transfer robot 36 (FIG. 1) removes the processed wafer. The back or unprocessed side of the wafer may be sprayed with a fluid to help remove residue. Transfer robot 36 may then transfer the processed wafer to another CMP system 22 for further processing or a cleaning station 26 for post-processing cleaning. After the processed wafer has been sufficiently planarized and cleaned, transfer robot 32 may return the processed wafer to one of caches 30.

Figure 3:
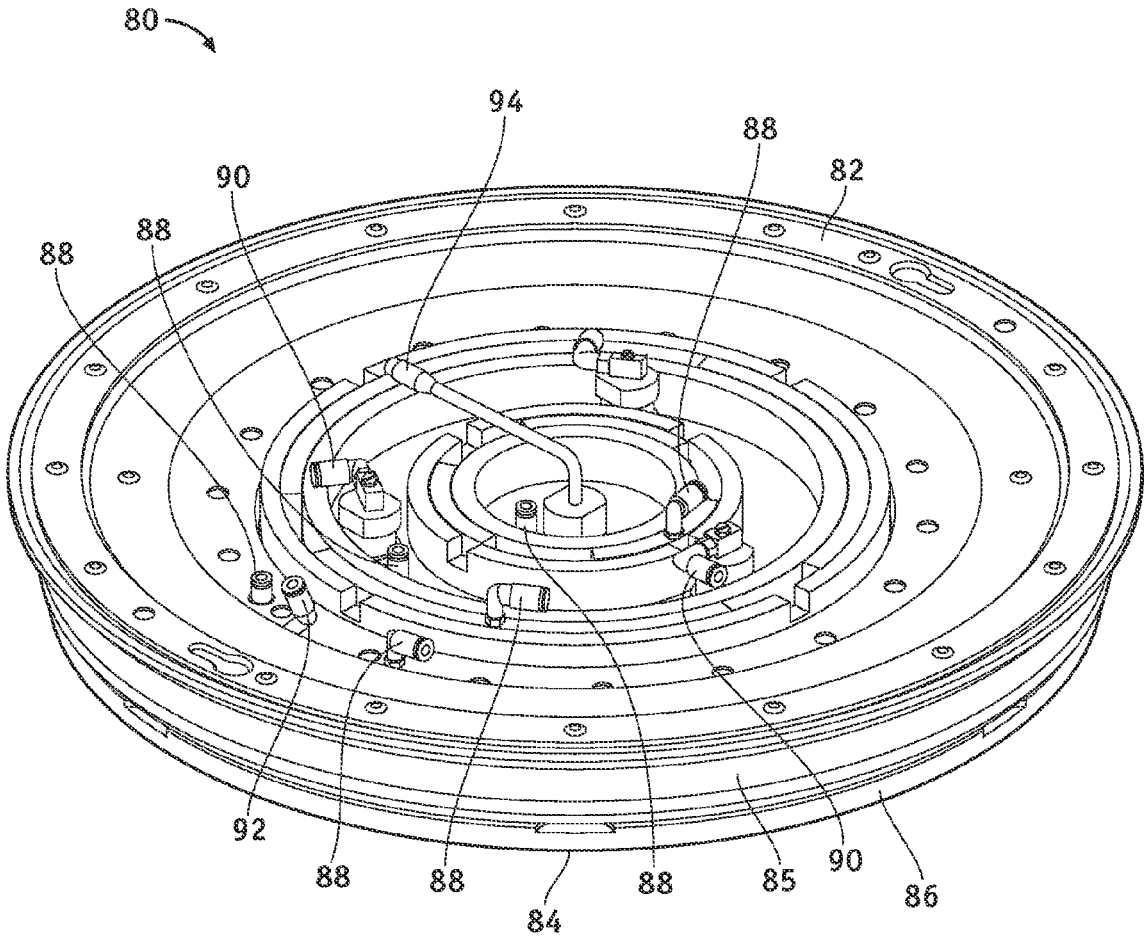
FIG. 3 is an isometric view of a carrier head in accordance with a first exemplary embodiment of the present invention suitable for use in conjunction with the CMP systems shown in FIG. 2.

FIG. 3 is an isometric view of a carrier head 80 in accordance with a first exemplary embodiment of the present invention and suitable for use in conjunction with CMP apparatus 20 described above in conjunction with FIGS. 1 and 2. Carrier head 80 may be generally disc-like in shape and comprises an upper surface 82, a lower surface 84, and an annular rim portion 85. The outer annular portion of lower surface 84 is defined by a retaining ring 86 (also referred to as a wear ring). Retaining ring 86 encircles a flexible bladder (hidden from view in FIG. 3) and pre-stresses or pre-compresses the polish pad to protect the leading edge of the workpiece during polishing. As will be described below, the housing of carrier head 80 cooperates with the bladder to form a plurality (e.g., six) of pressure chambers or plenums. The pressure within each of these plenums may be independently manipulated to vary the pressure applied by the bladder to the wafer's back surface. A plurality of pneumatic fittings 88 permit the plenums to be fluidly coupled to an external source of pressure (e.g., via flexible connector tubing). Each fitting 88 is associated with a different pressure plenum. In the illustrated embodiment, carrier head 80 comprises six fittings 88 corresponding to six bladder plenums, and a seventh pneumatic fitting 92 corresponding to a retaining ring plenum. In addition to pneumatic fittings 88 and 92, carrier head 80 is provided with a plurality of pneumatic fittings 90, which allow a plurality (e.g., three) of ejectment mechanisms to be fluidly coupled to an external source of pressure as described below in conjunction with FIG. 11.

Carrier head 80 is also provided with an induction sensor 94, which may be disposed through a central portion of carrier head 80 as shown in FIG. 3. Induction sensor 94 may be coupled to an induction system (not shown), such as a closed-loop eddy current system, capable of determining the wafer topography during the CMP process. By utilizing such an induction system, a CMP apparatus (e.g., CMP apparatus 20) employing carrier head 80 may monitor the wafer's topographical features to determine which, if any, plenums require adjustments in pressurization. For example, the induction system may identify thicker wafer surface areas requiring a higher rate of removal, and the CMP apparatus may increase the pressure within the zone or zones corresponding to the thicker surface areas.

Figure 4:
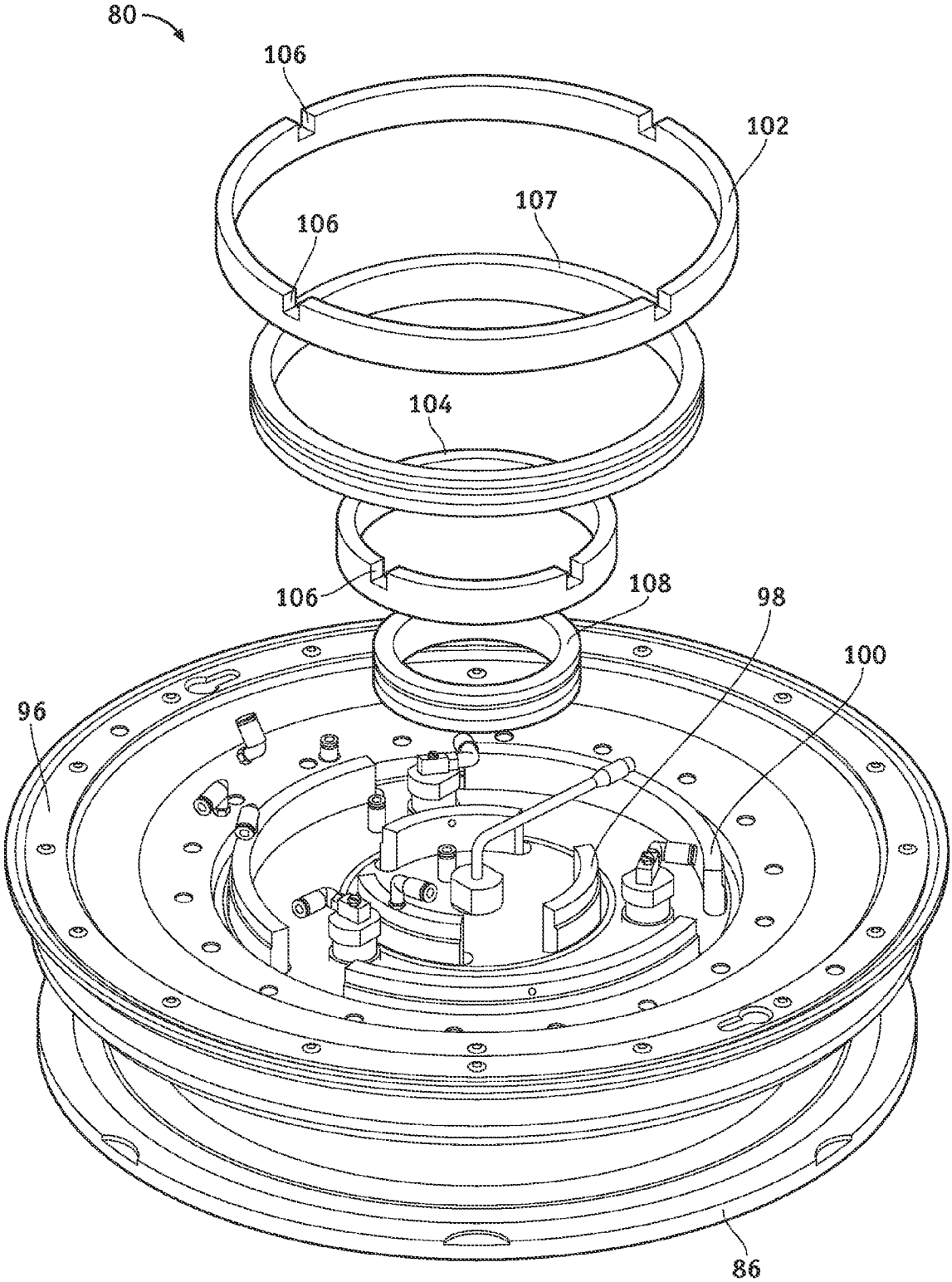
FIGS. 4 and 5 are first and second partially exploded views, respectively, of the carrier head shown in FIG. 3.

FIG. 4 is a partially exploded view of carrier head 80. The housing of carrier head 80 comprises: (1) retaining ring 86, (2) a mount plate 96, (3) an inner clamp ring 98, and (4) an intermediate clamp ring 100. Clamp rings 98 and 100 each comprise an annular base (hidden from view in FIG. 4) having a plurality of arcuate projections extending therefrom. Apertures provided through mount plate 96 receive the arcuate projections such that only the projections of retaining clamp rings 98 and 100 may be seen in FIG. 4. The outer circumferential walls of these projections are preferably threaded such that a first annular fastener may be threadably coupled to clamp ring 98 and a second annular fastener may be threadably coupled to clamp ring 100. For example, a first spanner nut 102 may be threadably coupled to the exposed arcuate projections of intermediate clamp ring 100, and a second spanner nut 104 may be threadably coupled to the exposed arcuate projections of inner clamp ring 98. Spanner nuts 102 and 104 may each include a plurality of radially transverse notches or slots 106 therein to permit tightening with a pronged tool (not shown). This design permits a single annular fastener to be utilized to secure a clamp ring to mount plate 96. Spanner nuts 102 and 104 may be easily removed to permit clamp rings 98 and 100, respectively, (and the carrier head bladder) to be decoupled from mount plate 96. In this manner, the spanner nut/clamp ring assemblies permit carrier head 80 to be quickly and easily disassembled to facilitate routine maintenance and refurbishing (e.g., replacement of exhausted bladders).

In contrast to conventional bolt/clamp ring assemblies described in the background above, annular fasteners 102 and 104 each produce a relatively low and more evenly distributed axial clamping force. As a result, mount plate 96, inner clamp ring 98, and intermediate clamp ring 100 may be produced from materials having lower compressive strengths. Preferably, the chosen material is lightweight so as to permit easier manipulation of carrier head 80 and non-conductive so as to minimize interference (e.g., signal attenuation) with the induction system coupled to induction sensor 94; e.g., certain polymers may be employed including various plastics. If the clamp rings are made from a relatively pliable material, it may be desirable to provide supports for the accurate projections of clamp ring 98 and of clamp ring 100. This may be accomplished by, for example, disposing (e.g., press-fitting) first and second stiffening rings 107 and 108 along the inner circumference of clamp rings 98 and 100, respectively.

Figure 5:
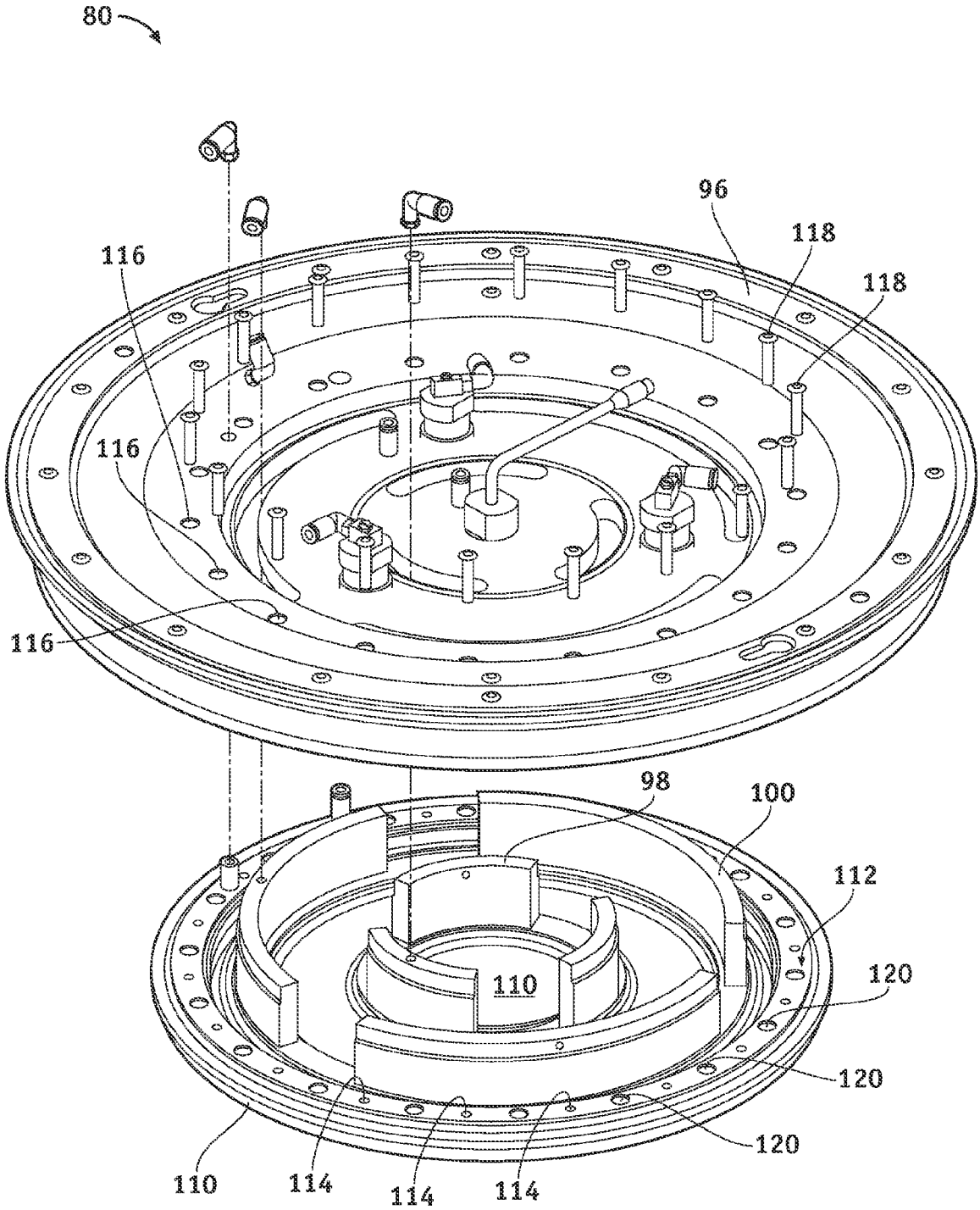

FIG. 5 is a partially exploded view of carrier head 80 absent retaining ring 86, annular fasteners 102 and 104, and stiffening rings 107 and 108. In this view, bladder 110 (described in detail below in conjunction with FIG. 7) and a first outer clamp ring 112 may be seen. Like clamp rings 98 and 100, outer clamp ring 112 has a generally annular shape, although the outer diameter of outer clamp ring 112 is substantially larger than that of clamp ring 98 and slightly larger than that of intermediate clamp ring 100. Unlike clamp rings 98 and 100, however, outer clamp ring 112 does not include a plurality of arcuate projections that may be threadably coupled to an annular fastener. Instead, outer clamp ring 112 is coupled to mount plate 96 by way of a plurality of fasteners 118 (e.g., bolts). When outer clamp ring 112 is properly aligned with mount plate 96, fasteners 118 extend through apertures 116 provided through mount plate and apertures 114 provided through clamp ring 112. In the embodiment shown in FIG. 5, the diameters of apertures 116 are enlarged (relative to the diameters of apertures 114) to accommodate the heads of fasteners 118.

Figure 6:
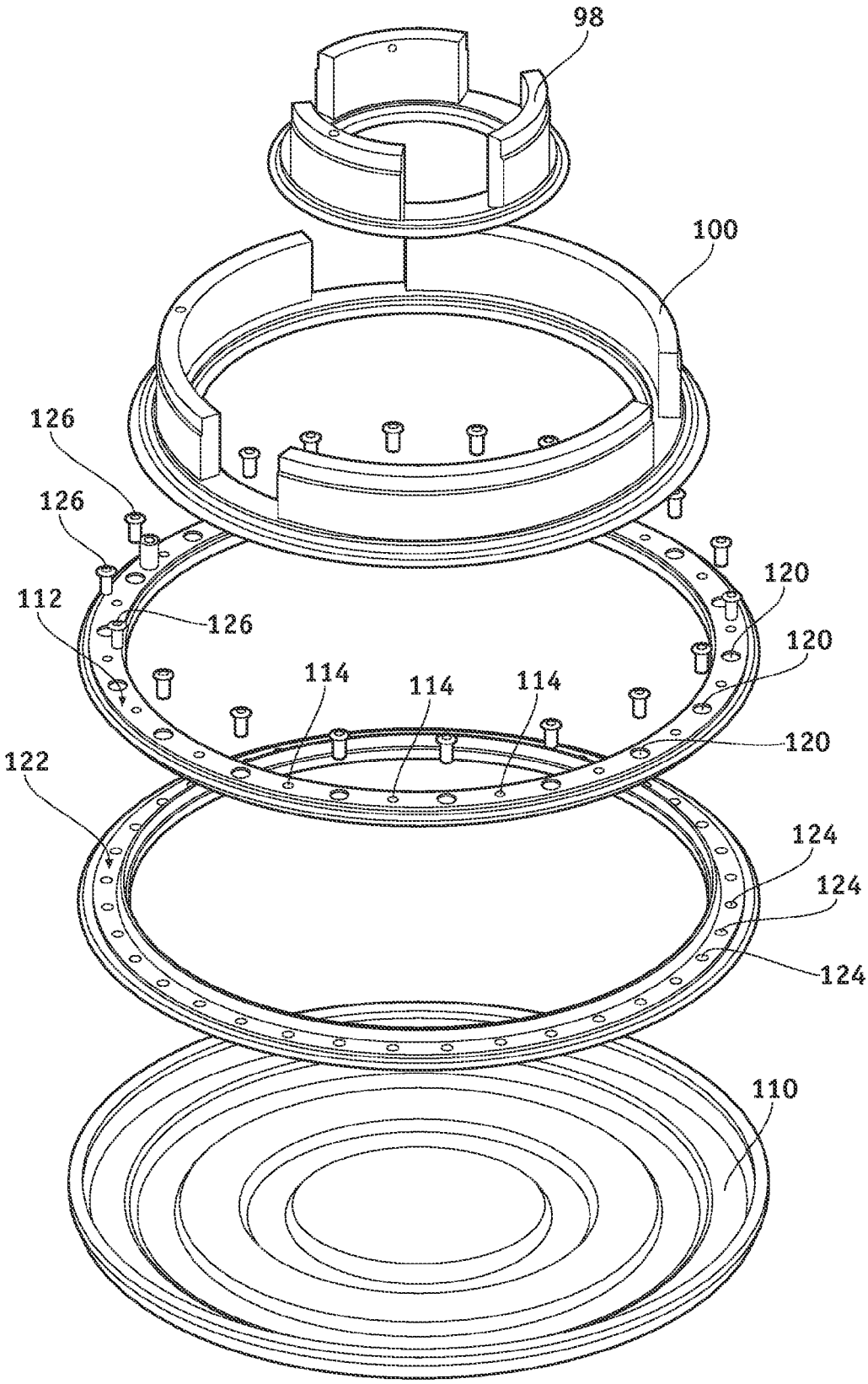
FIG. 6 is an exploded view of the lower portion of the carrier head shown in FIGS. 3-5.

A second plurality of apertures 120 is circumferentially interspersed with apertures 114 along the upper axial face of clamp ring 112. Apertures 120 extend through clamp ring 112 and permit ring 112 to be coupled to a second outer clamp ring 122 shown in FIG. 6 (an exploded view of the lower portion of carrier head 80). As can be seen in FIG. 6, outer clamp ring 122 has a generally annular shape similar to clamp ring 112 and includes a plurality of apertures 124 therein. When outer clamp ring 122 is properly aligned with outer clamp ring 112, each of apertures 120 co-axially align with one of apertures 114 or apertures 124. A fastener 126 (e.g., a bolt) is disposed through each pair of apertures to couple outer clamp ring 122 to outer clamp ring 112. As was the case previously, the diameters of apertures 120 may be enlarged (relative to the diameters of apertures 124) to accommodate the heads of fasteners 126.

Figure 7:
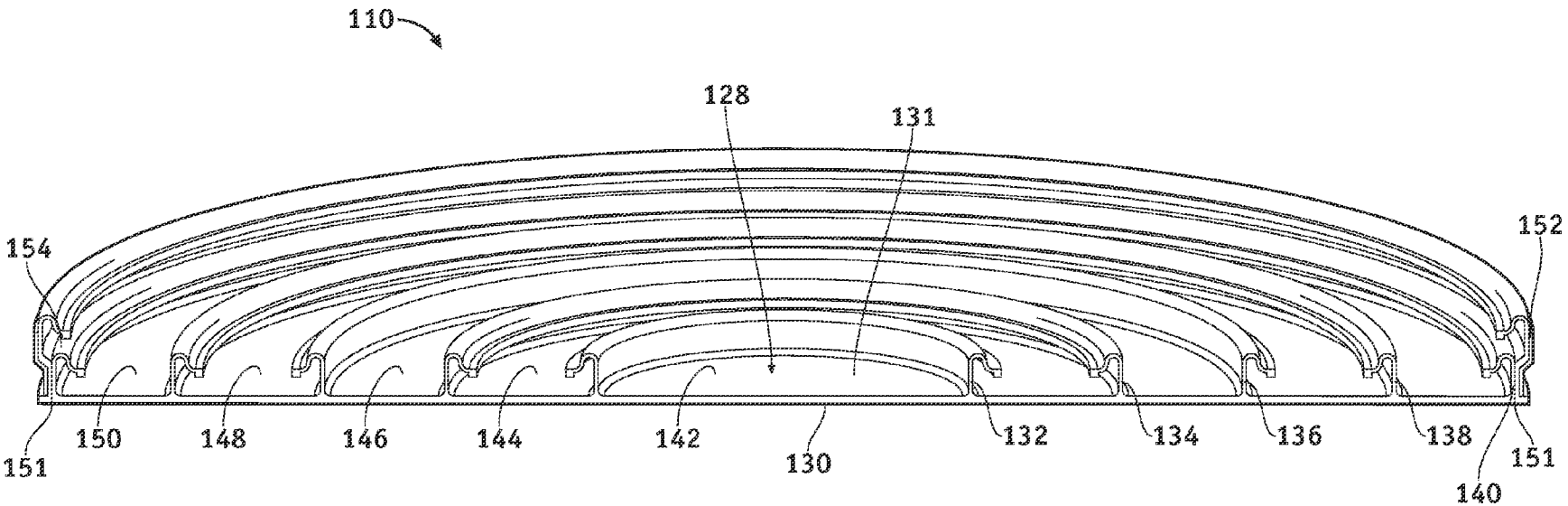
FIG. 7 is an isometric, cross-sectional view of the bladder of the carrier head shown in FIG. 3-6.

FIG. 7 is a cross-sectional, isometric view of bladder 110. Bladder 110 comprises a flexible base diaphragm 128 having a first working surface 130, which contacts a workpiece (e.g., a semiconductor wafer) during planarization/polishing, and a second surface 131 opposite surface 130. A plurality of annular ribs (e.g., five) extends from surface 131 to partially define a plurality (e.g., five) of concentric pressure chambers or plenums. Working outward from the center of bladder 110, the ribs are numbered 132, 134, 136, 138, and 140. Similarly, the plenums are numbered 142, 144, 146, 148, and 150. Plenum 142 is laterally defined by rib 132, plenum 144 by ribs 132 and 134, plenum 146 by ribs 134 and 136, plenum 148 by ribs 136 and 138, and plenum 150 by ribs 138 and 140.

It will be noted that bladder 110 includes an additional rib 152 disposed along the outer circumference of diaphragm 128. Rib 152 extends from the upper peripheral edge of bladder 110 to the lower peripheral edge of bladder 110. An inner surface of rib 152 is coupled (e.g., integrally) to an outer annular surface of rib 140, and an end portion of rib 142 is coupled to the outer peripheral edge of diaphragm 128. To help distinguish rib 152 in FIG. 7, dotted lines 151 separate rib 152 from rib 140 and from diaphragm 128. Rib 152 cooperates with an upper portion of rib 140 to partially define an additional plenum 154. As suggested by its peripheral disposition of rib 152, plenum 154 and rib 152 are utilized to control the outer edge of diaphragm 128 during planarization/polishing as described below in conjunction with FIG. 10. As will be seen, plenum 154 may be selectively pressurized to control the vertical displacement of rib 152 and, therefore, the planarization/polishing characteristics (e.g., the rate of removal) along the outer edge of a wafer during CMP processing.

The annular ribs may be integrally formed with diaphragm 128 and may each comprise a vertical column having first and second substantially opposite end portions. The annular ribs are preferably oriented substantially orthogonally to the plane of diaphragm 128. In preferred embodiments, each annular rib comprises a strain relief member (e.g., an annular brim having a generally J-shaped cross-section) disposed intermediate the first and second end portions. The strain relief members permit greater vertical displacement of the annular ribs and, consequently, permit a greater range of motion substantially orthogonally to working surface 130 (referred to as a "longer throw"). However, it will be appreciated by one skilled in the art that any or all of the provision of strain relief members is optional and, similarly, that each of the annular ribs may assume a variety of other shapes (e.g., an annular lip having a generally L-shaped cross-section) suitable for attachment to the housing of carrier head 80 (e.g., to clamp rings 98, 100, 112, and/or 122).

Figure 8:
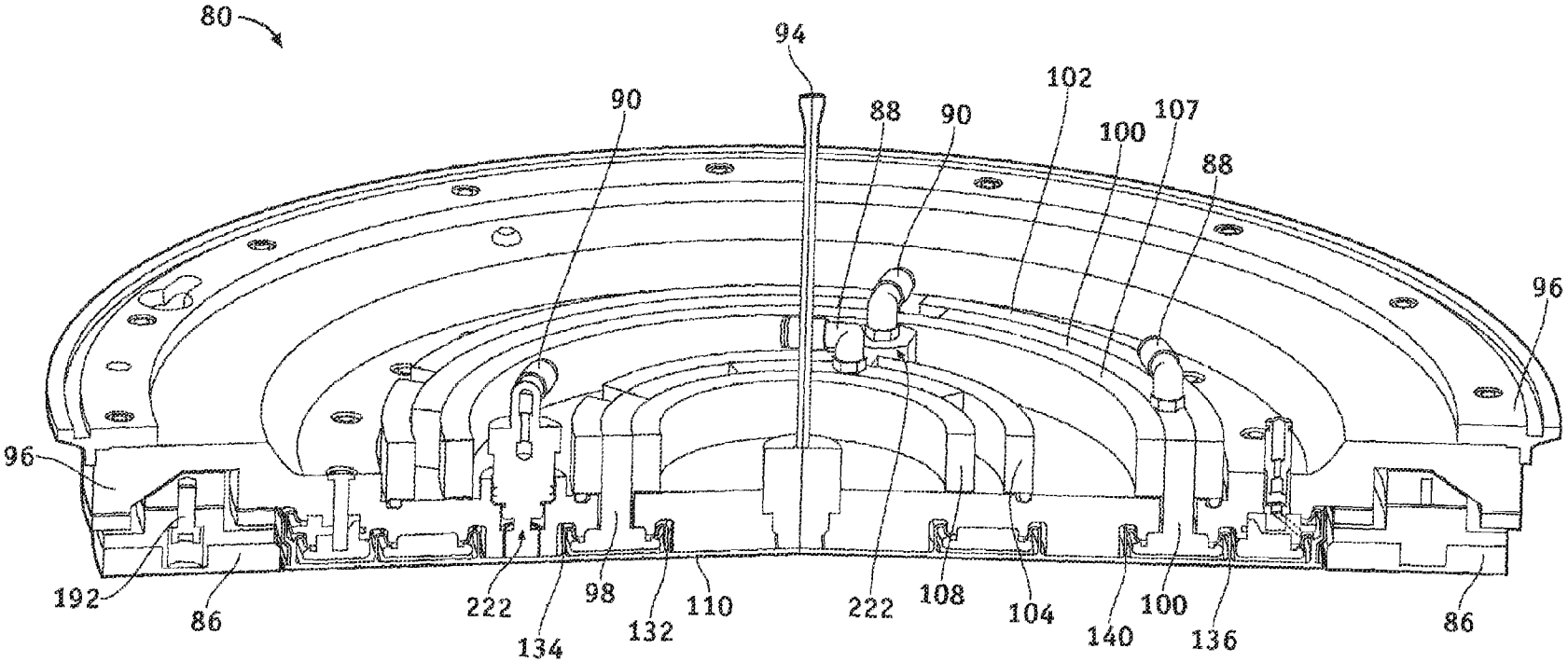
FIG. 8 is a cross-sectional view of the carrier head shown in FIGS. 3-6.

FIG. 8 is a cross-sectional, isometric view of carrier head 80. Retaining ring 86 is coupled to mount plate 96 via a plurality of fasteners (e.g., bolts) 192 (only one of which may be seen in FIG. 8). The inner diameter of retaining ring 86 is chosen to be slightly larger than the outer diameter of the workpieces to be processed (e.g., 300 mm semiconductor wafers). As stated previously, retaining ring functions to prestress or pre-compress the polish pad so as to protect the leading edge of the workpiece during polishing. As such retaining rings are well known in the art, no further discussion is deemed necessary at this time.

FIG. 8 also illustrates the manner in which the annular ribs of bladder 110 are sealingly secured between mount plate 96 and clamp rings 98 and 100. Since clamp rings 98 and 100, spanner nuts 102 and 104, and the annular ribs secured thereby are similar in structure, only the manner in which spanner nut 104 couples clamp ring 98 to mount plate 96 to sealingly secure annular ribs 132 and 134 will be described below.

Figure 9:
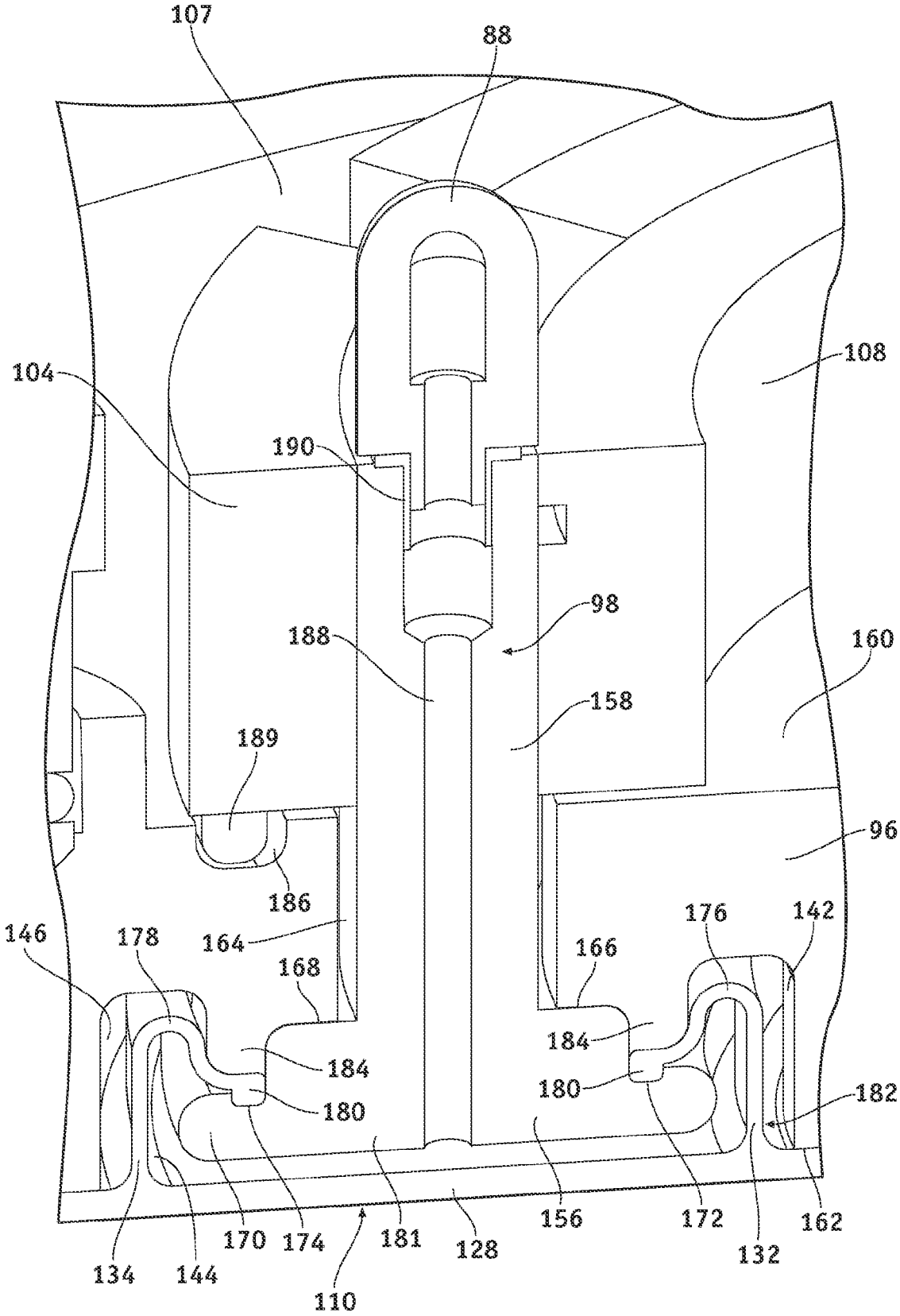
FIG. 9 is a detailed cross-sectional view of a portion of the carrier head shown in FIGS. 3-6 illustrating bladder attachment.

FIG. 9 is a detailed cross-sectional view of a portion of carrier head 80 including clamp ring 98, spanner nut 104, and annular ribs 132 and 134. Clamp ring 98 comprises an annular base 156 and an arcuate projection 158 extending therefrom. Mount plate 96 includes a first surface 160, a second surface 162 substantially opposite surface 160, and an aperture 164 extending from surface 160 to surface 162. Projection 158 is inserted through aperture 164, and spanner nut 104 is coupled (e.g., threadably) to the outer portion of projection 158 that protrudes through aperture 164. Base 156 has a larger outer diameter than does aperture 164; thus, base 156 abuts mount plate 96 when projection 158 is inserted through aperture 164. In particular, base 156 includes an inner circumferential step 166 and an outer circumferential step 168 that abut mount plate 96 proximate aperture 164 as shown in FIG. 9.

Base 156 further comprises a foot portion 170 having first and second annular recesses 172 and 174 therein. Ribs 132 and 134 each include a region 180 of increased thickness proximate an end portion thereof; e.g., proximate the annular rib's inner circumference as shown in FIG. 9. When clamp ring 98 is attached to bladder 110, regions 180 are received within recesses 172 and 174, which serve to seat and secure regions 180. Spanner nut 104 engages first surface 160 of mount plate 96 to sealingly deform regions 180 between base 170 and mount plate 96 in the manner described below. To provide support to bladder 110 during operation (e.g., to prevent bladder 110 from caving inward when a partial vacuum is created in plenum 144), lower surface 181 of foot portion 170 may comprise a flat surface that is substantially parallel the diaphragm of bladder 110 as shown in FIG. 9.

Mount plate 96 includes an annular depression 182 in surface 162 that receives base 156 when projection 158 is inserted through aperture 164. Depression 182 also affords ribs 132 and 134, including respective strain relief members 176 and 178, with space in which to flex. Mount plate 96 further includes first and second ridges 184 proximate aperture 164. Within depression 182, ridges 184 extend from mount plate 96 to (1) abut steps 166 and 168, and (2) to contact regions 180 of ribs 132 and 134. During assembly, as spanner nut 104 is tightened, base 156 moves toward mount plate 96, and regions 180 are compressed between base 170 of clamp ring 98 and ridges 184 of mount plate 96. Regions 180 thus deform to contact the inner walls of recesses 172 and 174, and a seal is formed between bladder 110 and clamp ring 98. Steps 166 and 168 abut ridge 184 to prevent over-tightening and extrusion of regions 180. To preclude spanner nut 104 from exerting too high an axial force during tightening, a soft stop may be provided. For example, an annular recess 186 may be provided in surface 160 (e.g., where spanner nut 104 contacts with mount plate 96), and a resilient member (e.g., an elastomer washer) 189 may be disposed within recess 186.

It should be appreciated from the forgoing description that ribs 132 and 134 of bladder 110 are sealingly secured between base 156 of clamp ring 98 and surface 162 of mount plate 96 when spanner nut 104 is threadably coupled to projection 158 of clamp ring 98. Thus, by sealing securing ribs 132 and 134 in this manner, two plenums are fully sealed (i.e., plenums 142 and 144), and one plenum is partially sealed (i.e., plenum 146). As may be seen in FIG. 8, ribs 136 and 138 are secured between the foot portion of clamp ring 100 and surface 162 of mount plate 96 in a similar fashion. By further sealingly securing ribs 136 and 138, plenums 146 and 148 (labeled in FIG. 7) are also sealed. Plenum 154 is sealed is a different manner described below in conjunction with FIG. 10.

To permit plenum 144 to be fluidly coupled to an external source of pressure, a passage 188 (e.g., a pneumatic passage) extends through base 156 and projection 158 of clamp ring 98. If desired, a fitting 88 (e.g., a standardized quick connect fitting) may be coupled to projection 158; e.g., a threaded insert 190 may be bonded to an inner portion of projection 158, and fitting 88 may be threadably coupled to insert 190. Fitting 92 may receive an end of a flexible tube coupled to an external source of pressure as described above in conjunction with FIG. 3. Similar pneumatic passages are also provided through clamp rings 100 and 112 to permit fluid communication with plenums 148 and 154, respectively; and a plurality of pneumatic passages is provided through mount plate 96 to provide fluid communication with plenums 142, 146, and 150 (FIG. 7).

Figure 10:
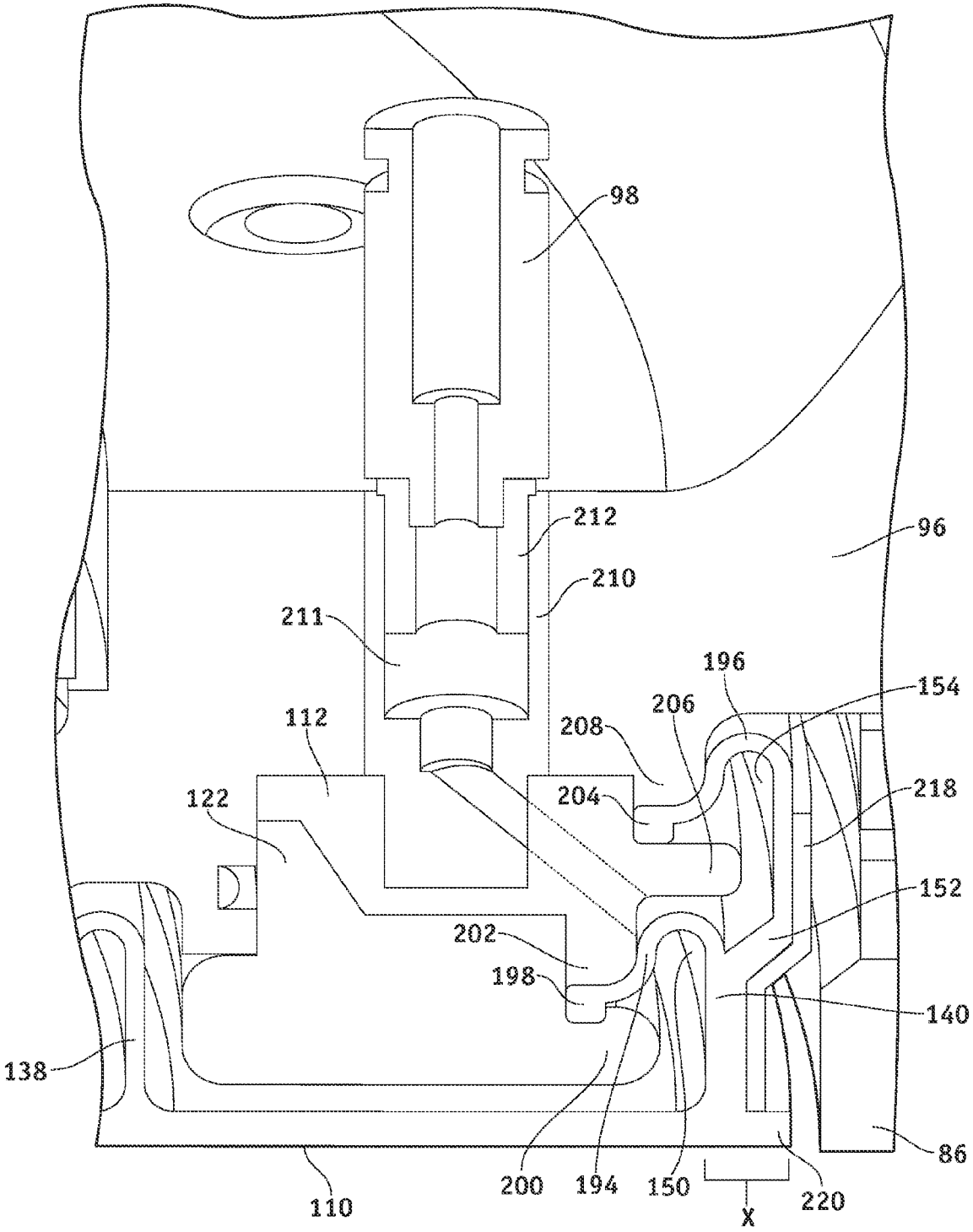
FIG. 10 is a detailed cross-sectional view of the edge control system deployed on the carrier head shown in FIGS. 3-6.

FIG. 10 is a cross-sectional view of an outer portion of carrier head 80 illustrating an exemplary embodiment of the inventive edge control system. Two plenums are shown in FIG. 10: i.e., plenum 150, which is defined by outer clamp ring 122 and annular ribs 138 and 140; and plenum 154, which is defined by outer clamp ring 112 and annular ribs 140 and 152. Annular ribs 140 and 152 include strain relief members 194 and 196, respectively, which are similar to strain relief members 176 and 178 described above in conjunction with FIG. 9. In addition, annular ribs 140 and 152 each further include a region of increased thickness 198 formed at an end portion thereof. Region 198 is received by an annular recess provided in a circumferential shelf 200 disposed around clamp ring 122. When clamp ring 122 is secured to clamp ring 112 via fasteners 118 (FIG. 5) and 126 (FIG. 6), region 198 is compressed between outer clamp ring 122 and a ledge 202 extending downward from outer clamp ring 112. In this manner, region 198 forms a seal between shelf 200 and ledge 202. As a result, the outer peripheral wall of plenum 150 is sealed between bladder 110 and outer clamp ring 122.

Region 204 of annular rib 152 is also received by an annular recess provided in a circumferential shelf 206 disposed around an outer periphery of clamp ring 112. When clamp ring 112 is secured to mount plate 96 via fasteners 118 (FIG. 5), region 204 is compressed between the walls of circumferential shelf 206 and a ledge 208 extending from mount plate 96 thereby forming a seal between mount plate 96 and clamp ring 112, and sealing plenum 154. In the illustrated embodiment, plenums 150 and 154 are sealed as ribs 140 and 152 are secured between stacked clamp rings (i.e., clamp rings 112 and 122) and mount plate 96; however, it should be appreciated that plenums 150 and 154 may be sealed and that ribs 140 and 152 may be secured utilizing other structural configurations, including, but not limited to, an annular fastener/clamp ring assembly similar to that described above in conjunction with FIG. 9.

To permit plenum 154 to be fluidly coupled to an external source of pressure, a passage 211 (e.g., a pneumatic passage) is provided through clamp ring 112 and mount plate 96. For example, a first fitting 210 may be disposed in an aperture provided through mount plate 96. A threaded insert 212 is bonded to an inner portion of fitting 210, and a second fitting 92 (e.g., a standardized quick connect fitting) is threadably coupled to insert 212. Passage 211 may extend through clamp ring 112, fitting 210, insert 212, and fitting 92 to fluidly engage plenum 154.

Plenum 154 is selectively pressurized to control the vertical displacement of rib 152 and, to some extent, of rib 140, which are each coupled to bladder 110 proximate an outer peripheral edge thereof. Consequently, selective pressurization of plenum 154 permits adjustment of an outer peripheral zone of bladder 110 (labeled X in FIG. 10). By providing increased bladder control proximate the outer peripheral edge of the bladder, carrier head 80 allows the planarization of the outer edge of the wafer (e.g., the outer 4-5 mm of a 300 mm wafer) to be more precisely managed. To enhance the vertical displacement of rib 140 and/or rib 152, the inventive edge control system may include a guide member disposed proximate ribs 140 and 152. For example, and as shown in FIG. 10, an annular stiffening band 218 may be coupled (e.g., adhesively) to the outer edge of bladder 110. Stiffening band 218 is preferably configured to have a relatively slim cross-sectional profile to minimize obstruction of retaining ring 86. At the same time, stiffening band 218 is preferably configured to maximize overhang (i.e., the distance between region 198 and the outer peripheral edge or rib 152). To this end, stiffening band 218 may comprise an upper annular portion that is substantially contiguous with an upper portion of rib 152, and a lower annular portion that is substantially contiguous with a lower portion of rib 152. Stated differently, stiffening band 218 may be disposed such that an upper portion of rib 152 resides between an upper annular portion of band 218 and plenum 154, and a lower portion or rib 152 resides between a lower annular portion of band 218 and rib 140. Preferably, the outer diameter of the first annular portion is chosen to be slightly larger than the outer diameter of the second annular portion as shown in FIG. 10. To prevent damage to wafers, the lower end of stiffening band 218 may not extend through to the working surface of bladder 110, but instead may abut an outer annular ledge 220 provided around bladder 110.

Figure 11:
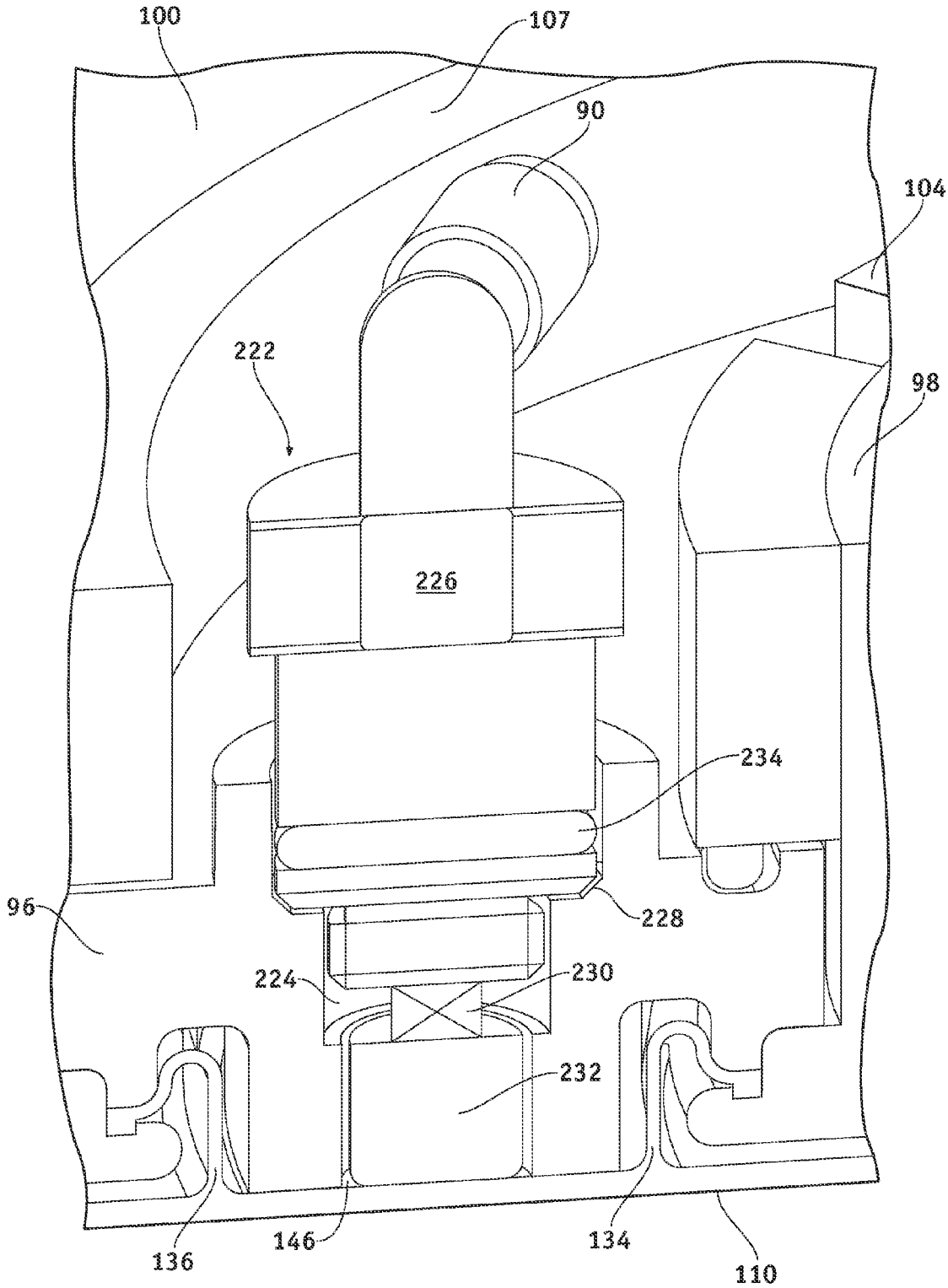
FIG. 11 is a cross-sectional view of the ejectment system deployed on the carrier head shown in FIGS. 3-6.

FIG. 11 is a detailed view, partially in cross-section, of an ejectment mechanism 222 disposed through an aperture 224 provided through mount plate 96. Ejectment mechanism 222 comprises a cylindrical casing 226 that abuts mount plate 96 proximate aperture 224 (indicated in FIG. 9 at 228). A piston 230 is coupled to casing 226 and configured to translate with respect thereto. Piston 230 is coupled at its distal end to a plunger head 232. Piston 230 and plunger head 232 reside within plenum 146, which is laterally defined by ribs 134 and 136. To preserve the hermetic integrity of plenum 146, ejectment mechanism 222 preferably forms a seal with mount plate 96. As shown in FIG. 11, such a seal may be formed by disposing an elastomer o-ring 234 around a portion of casing 226 that is encompassed by mount plate 96.

Though ejectment mechanism 222 may comprise a wide variety of actuators (e.g., an electric or hydraulic actuator), mechanism 222 is preferably a pneumatic linear actuator. A pneumatic fitting 90 is coupled to casing 226 to permit ejectment mechanism 222 to be fluidly coupled to an external source of pressure. Piston 230 is biased (e.g., by a spring internal to casing 226) toward a retracted position (illustrated in FIGS. 8 and 11) in which head 232 resides adjacent bladder 110. When ejectment mechanism 222 is sufficiently pressurized, piston 230 extends away from casing 226 and plunger head 232 presses against bladder 110. This creates a localized protuberance or bulge along the working surface of the bladder 110 proximate mechanism 222. By simultaneously actuating each of a plurality of ejectment mechanisms 222, a wafer supported carrier head 80 may be ejected (i.e., forced away from bladder 110). Ejectment mechanisms 222 are preferably disposed in an array that evenly distributes the force of ejection over the wafer's back surface. For example, as indicated by FIG. 8, a plurality (e.g., three) of ejectment mechanisms 222 may be arranged around mount plate 96. In contrast to ejectment techniques involving the pressurization of the central plenum, utilizing a plurality of ejectment mechanisms 222 in this manner does not create suction between bladder 110 and a supported wafer.

Figure 12:
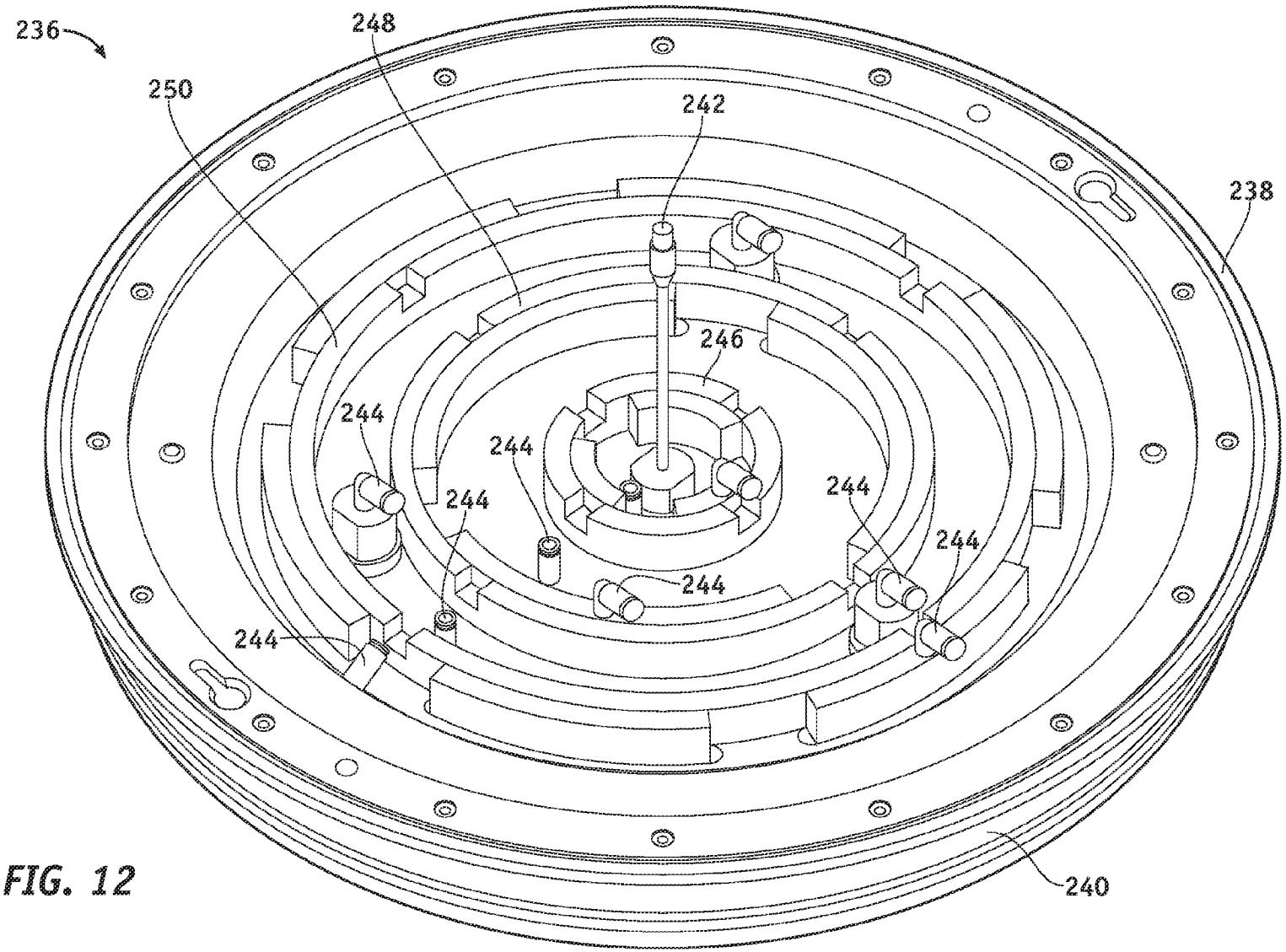
FIG. 12 is an isometric view of a carrier head employing three spanner nut/clamp ring assemblies in accordance with a second exemplary embodiment of the present invention.

Though described above as having a particular number of ejectment mechanisms and a particular number of spanner nut/clamp ring assemblies, it should be understood that alternative embodiments of the inventive carrier head may employ more or less of these components. As an example, FIG. 12 is an isometric view of a carrier head 236 in accordance with a second embodiment of the present invention. In many respects, carrier head 236 is similar to carrier head 80; carrier head 236 comprises a mount plate 238, a retaining ring 240, a flexible bladder (hidden from view), an induction sensor 242, and a plurality of pneumatic fittings 244. Like carrier head 80, carrier head 236 also comprises first and second spanner nut/clamp ring assemblies 246 and 248 that sealingly secure the annular ribs of the bladder to mount plate 238 as described above. However, unlike carrier head 80, carrier head 236 further comprises a third spanner nut/clamp ring assembly 250 to sealingly secure the outer peripheral portion of the bladder to mount plate 238. Spanner nut/clamp ring assembly 250 thus replaces fasteners 118 (FIG. 5) and fasteners 126 (FIG. 6) employed by carrier head 80. By utilizing a plurality of spanner nut/clamp ring assemblies in this manner, carrier head 236 simplifies assembly/disassembly and streamlines carrier head refurbishment (e.g., replacement of exhausted bladders).

In view of the foregoing description, it should be appreciated that a CMP carrier head has been provided that overcomes many of the limitations associated with conventional carrier head designs. In particular, it should be appreciated that the inventive carrier head employs an improved bladder attachment design that utilizes less components, that facilitates refurbishing, and that permits components of the carrier head (e.g., the carrier housing) to be made of materials having lower compressive strengths (e.g., a polymer, such as plastic). In addition, it should be appreciated that the inventive carrier head employs an improved ejection system that does not unduly stress the wafer or create suction between the wafer and the bladder during ejectment. Finally, it should be appreciated that the inventive carrier head employs an edge control system capable of providing improved bladder control proximate the outer edge of the wafer during planarization/polishing.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. An edge control system for deployment on a CMP carrier head comprising a bladder and a carrier head housing having a passage extending therethrough, the bladder includes a flexible diaphragm and is coupled to the carrier head housing, the edge control system comprising:

first and second annular ribs each comprising:

a first end portion sealingly coupled to the carrier head housing;

a second end portion coupled to the diaphragm; and a flexible strain relief member coupling said first end portion to said second end portion; and a plenum substantially defined by said first and second annular ribs and said carrier head housing, the passage fluidly coupled to said plenum to permit pressurization thereof, said strain relief member promoting the extension of said first and second annular ribs away from the carrier head housing when said plenum is pressurized.

2. An edge control system according to claim 1 wherein said second end portion is substantially orthogonal to the diaphragm and integrally formed therewith.

3. An edge control system according to claim 1 wherein said first and second annular ribs reside proximate an outer peripheral edge of the diaphragm.

4. An edge control system according to claim 1 wherein said first and second annular ribs are substantially adjacent.

5. An edge control system for deployment on a CMP carrier head comprising a bladder and a carrier head housing having a passage extending therethrough, the bladder includes a flexible diaphragm and is coupled to the carrier head housing, the edge control system comprising:

first and second annular ribs each comprising:

a first end portion sealingly coupled to the carrier head housing;

a second end portion coupled to the diaphragm; and a strain relief member substantially intermediate said first end portion and said second end portion; and a plenum substantially defined by said first and second annular ribs and said carrier head housing, the passage fluidly coupled to said plenum to permit pressurization thereof, said strain relief member promoting the extension of said first and second annular ribs away from the carrier head housing when said plenum is pressurized;

wherein said first and second annular ribs are substantially adjacent and an inner surface of said first annular rib is coupled to an outer surface of said second annular rib.

6. An edge control system according to claim 1 wherein said second end portion comprises a region of increased thickness proximate the inner circumference thereof.

7. An edge control system according to claim 1 further comprising a stiffening band disposed proximate said first annular rib.

8. An edge control system according to claim 7 wherein said stiffening band is substantially contiguous with an outer circumference of said first annular rib.

9. An edge control system according to claim 8 wherein said stiffening band comprises:

a first annular portion substantially contiguous with a first segment of said first annular rib, said first segment residing proximate the carrier head housing and disposed between said first annular portion and said plenum; and a second annular portion substantially contiguous with a second segment of said first annular rib, said second segment residing proximate the diaphragm and disposed between said first annular portion and said second annular rib.

10. An edge control system according to claim 1 wherein said first and second annular ribs and said strain relief member are substantially concentric.

11. A carrier head for supporting a workpiece, the carrier head comprising:

a carrier head housing, comprising:

a mount plate;

a first clamp ring coupled to said carrier head housing such that said second end portion of said first annular rib is sealingly secured between said first clamp ring and said carrier head housing; and a second clamp ring coupled to said first clamp ring such that said second end portion of said second annular rib is sealingly secured between said first clamp ring and said second clamp ring;

a bladder, comprising:

a flexible diaphragm having a first surface, a second surface substantially opposite said first surface, and an outer peripheral edge;

a first annular rib having a first end portion and a second end portion, said first end portion coupled to said first surface proximate said outer peripheral edge, and said second end portion sealingly coupled to said carrier head housing; and a second annular rib having a first end portion and a second end portion, said first end portion coupled to said first surface and to said first annular rib, and said second end portion sealingly coupled to said carrier head housing; and a first plenum defined by said carrier head housing, said first annular rib, and said second annular rib, said first annular rib and said second annular rib moving towards said flexible diaphragm when said first plenum is pressurized to produce an annular protrusion along said second surface of said diaphragm.

12. A carrier head according to claim 11 wherein said first clamp ring and said second clamp ring each comprise a circumferential shelf having an annular recess therein configured to receive said second end portion.

13. A carrier head according to claim 11 further comprising a passage through said mount plate and said first clamp ring configured to fluidly couple said first plenum to an external source of pressure.

14. A carrier head according to claim 11 wherein said first annular rib further comprises a first strain relief member adjacent said second end portion and residing proximate said mount plate, and wherein said second annular rib further comprises a second strain relief adjacent said second end portion and residing proximate said first clamp ring.

15. A carrier head according to claim 11 where the carrier head further comprises a second plenum and a third annular rib coupled between said carrier head housing and said diaphragm, said second plenum substantially defined by said second annular rib, said third annular rib, and said carrier head housing.

16. A carrier head according to claim 11 further comprising an annular stiffening ring disposed about the outer peripheral edge of said bladder.

* * * * *